United States Patent [19]

Lemmer et al.

[11] Patent Number: 4,931,757

[45] Date of Patent: Jun. 5, 1990

[54] CONTACTOR AND/OR CIRCUIT BREAKER

[75] Inventors: Helmut Lemmer, Marienheide; Josef Risthaus, Gummersbach, both of Fed. Rep. of Germany

[73] Assignee: Square D Starkstrom GmbH, Fed. Rep. of Germany

[21] Appl. No.: 272,289

[22] Filed: Nov. 17, 1988

[30] Foreign Application Priority Data

Nov. 25, 1987 [EP] European Pat. Off. ..... 87117364.7

[51] Int. Cl.[5] ..... H01H 67/02

[52] U.S. Cl. ..... 335/131; 335/8

[58] Field of Search ..... 335/6, 8–9, 335/16, 14, 20, 35, 131–133

[56] References Cited

U.S. PATENT DOCUMENTS

| | | | |
|---|---|---|---|
| 4,531,172 | 7/1985 | Mertz | 335/6 |
| 4,644,308 | 2/1987 | Guery et al. | 335/131 |
| 4,688,011 | 8/1987 | Lemmer et al. | 335/132 |
| 4,713,636 | 12/1987 | Lemmer et al. | 335/35 |

*Primary Examiner*—Leo P. Picard
*Assistant Examiner*—Lincoln Donovan
*Attorney, Agent, or Firm*—Diller, Ramik & Wight

[57] ABSTRACT

A contactor which includes a contact bridge holder for opening and closing a first plurality of contacts of an electric circuit, a second plurality of additional contacts for each electrical phase and a coil connection of an associated magnetic system, respectively; the magnetic system including thermo trippers and magnetic trippers for selectively operating the first plurality of contacts, three actuation members each mounted for pivoting movement, the first of the actuation members being connected to a slider which is in turn connected to the second plurality of contacts, the second actuation member being operative by the magnetic tripper, the third actuation member being operative by the thermal tripper, the first and second actuation members having end portions which are normally in engagement when the trippers are not actuated and the second plurality of contacts are open, and the normally engaging end portions of the first and second actuating members are moved out of engagement upon the operation of either of the trippers resulting in operation of the slider and the opening of the second plurality of contacts.

30 Claims, 8 Drawing Sheets

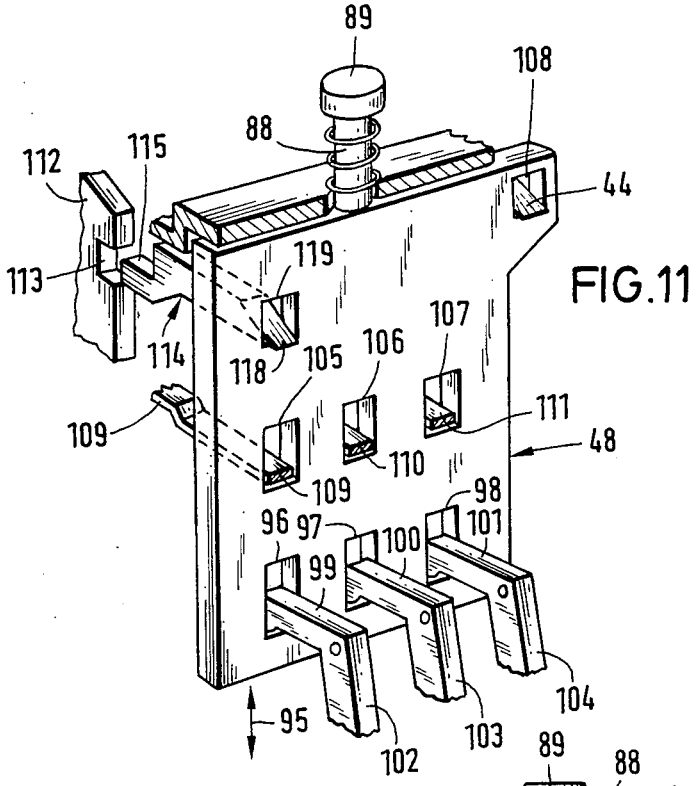
FIG.11
FIG.12
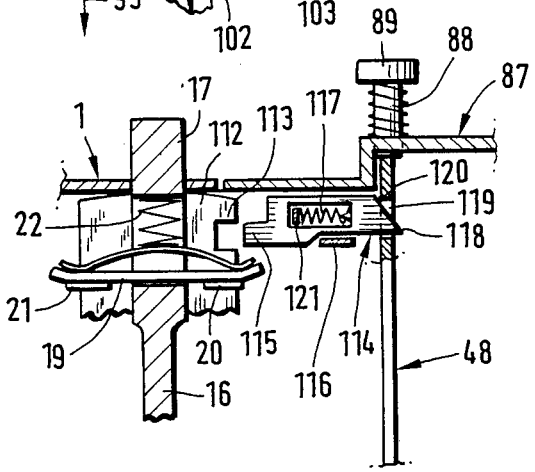

CONTACTOR AND/OR CIRCUIT BREAKER

BACKGROUND OF THE INVENTION

This invention concerns a contactor of the type which includes a magnetic system defined by a coil and a core of which the core is movable to selectively move a contact bridge holder and contacts carried thereby between open and closed positions for selectively opening and closing an electric circuit. Typically such contactors include conventional thermal trippers and magnetic trippers for each electrical phase and an appropriate actuator system for controlling the opening and closing of the contacts.

Various designs of contactors and motor protective switches are conventional, and ordinarily a motor protecting switch includes a contactor associated with a separate thermal protecting device (tripper) mounted in a separate housing. The system of contacts and the magnetic system driving the system of contacts are mounted in a single housing which is located either on the assembly side of the system of contacts or on the side of the system opposite (generally above) the assembly side. The conventional core of the magnetic system is connected to a contact bridge holder which carries contacts movable with the bridge holder between opened and closed positions of associated fixed contacts.

In another design a thermal tripper is present in the housing to operate or trip when the current or thermal load of a motor or the like exceeds a certain value. However, in spite of elaborate designs of such conventional contactors the thermal tripper operates unacceptably because the current (the thermal load) as a general rule increases very slowly. Obviously, because of such slow reaction it is difficult to protect an electrically motor against rapid current increases, and in most contactors of this type a separate safety mechanism is required and such mechanism is normally mounted in the separate housing outside of the contactor housing. Because of the latter, on the whole eighteen different connections are required between the various electrical terminals of such conventional contactors.

A lesser number of connections (twelve connections) are known in another conventional contactor which includes a magnetic system and a system of contacts which are connected through electrical conductors to a separate motor protecting switch. However, even twelve separate connections is unacceptable because the wiring of the contactor is complex, time consuming, and both manufacture and installation are expensive because of the added expenditure of money for materials for the many connectors of these conventional contactors. Aside from the cost involved, these conventional contactors also require a considerable amount of installation space, as when installed relative to a switching console.

In yet another known contactor, much of the wiring thereof is carried out largely within the contactor and the contactor is of a relatively compact design. This contactor includes thermal trippers for the three electrical phases and quick short trippers or magnetic trippers which drive a switch latch which through a system of contacts will open a motor protecting switch. An undervoltage or power tripper may also be provided. However, this contactor includes the drawback that switching between ON and OFF positions can only be carried out manually by actuating an associated ON/OFF button, except for the automatic shut off by the motor protecting switch.

There is a substantial demand for a contactor which can be automatically turned ON and OFF. Moreover, there is a need for turning the contactor ON and OFF by either than the manual or magnetic operation of the contact bridge holder and doing so by implementation from another suitable location. For instance, when the contactor is integrated into a switching console together with many other switches, it is desirable to operate the contactor between the ON and OFF positions manually or automatically from other than the conventional side heretofore provided, illustratively from a machine-tool that includes the to-be-protected electric motor.

Another relatively compact contactor is known which reduces wiring through a system of contacts and actuating means thereabove in one housing near the assembly side with the thermal and magnetic trippers for each electrical phase mounted on an adjacent side of the actuation means and cooperative therewith. On the other side of the actuation means there is a drive for the electromagnet with the armature thereof joined through knuckle joints to an extension of a common contact bridge holder of a system of contacts. Moreover, a slider is provided in this contactor which is engaged by the knuckle joints and by associated thermal and magnetic trippers.

In all of the foregoing conventional contactor designs there is explicit or implicit therein the assumption that upon overloading and tripping the contacts of the system of contacts actually do open every time. However, this is not often times the case. As regards contactors equipped with thermal and magnetic trippers, these trippers driven by actuation means act solely on the conventional system of contacts. Because of the great many switching steps carried out by such system of contacts and associate arcing and mechanical wear and metal fatigue, contact-welding can take place in an unforeseeable manner and time, whereby the ultimate desire for optimal reliability of switching is not obtained.

DESCRIPTION OF THE RELATED ART

Typical contactors or circuit breakers in the field of prior art to which this invention is directed are exemplified by U.S. Pat. Nos. 4,688,011 and 4,713,636 issued on Aug. 18 and Dec. 15, 1987, respectively in the name of Helmut Lemmer et al. and assigned to Square D. Starkstrom GmbH.

SUMMARY OF THE INVENTION

The present invention is directed to a relatively compact contactor requiring very little outside wiring, yet through integrated thermal and magnetic trippers providing high reliable switching which, in addition to the normal system of contacts, the contactor includes additional contacts which close during normal switching by the contactor and, therefore, are not subjected to excessive wear, arcing or contact welding, and even the latter danger is eliminated because the second set of contacts are normally biased toward their open position in the event of overload. Accordingly, when thermal trippers or magnetic trippers associated with the contacts are tripped or actuated, the biasing force is in the direction of opening the secondary or additional contacts which virtually assures opening thereof in virtually all cases of overload.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 11 is a fragmentary perspective view of the slider of FIGS. 3 through 10, and illustrates the relationship to the contact bridge holder to prevent slider movement unless the main contacts of FIGS. 1, 2, 5 and 6 are open.

FIG. 12 is a fragmentary vertical sectional detailed view of the assembly of FIG. 11, and illustrates the details of a spring-biased reciprocal lock associated with the slider and the contact bridge holder.

DESCRIPTION OF THE PREFERRED EMBODIMENTS

Figure 1:
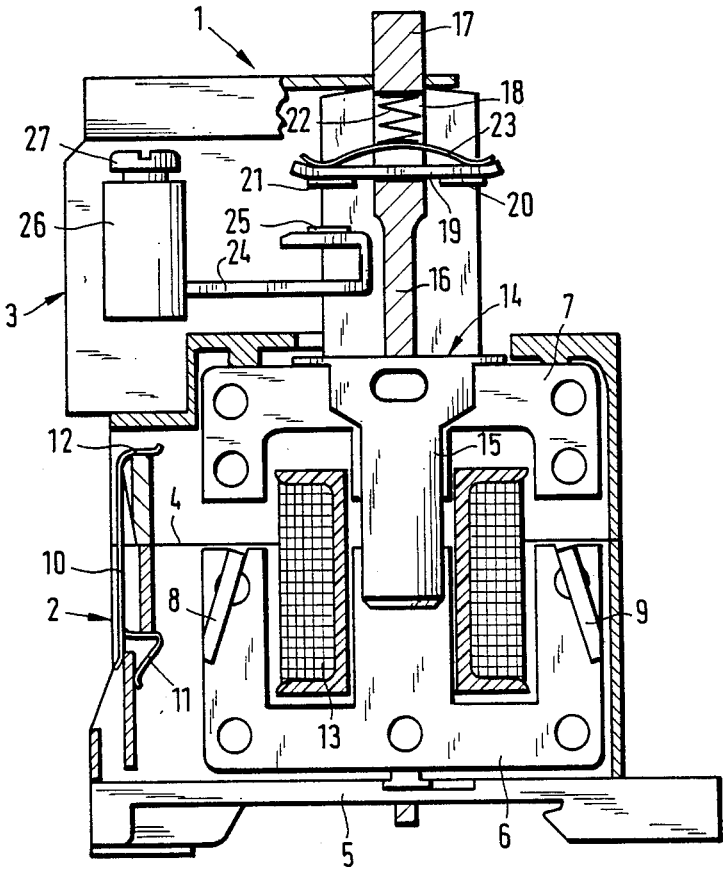
FIG. 1 is a vertical sectional view through a portion of the contactor of the present invention, and illustrates a contact bridge holder, contacts carried thereby, fixed contacts associated therewith, and a core and coil of a magnetic system.
Figure 2:
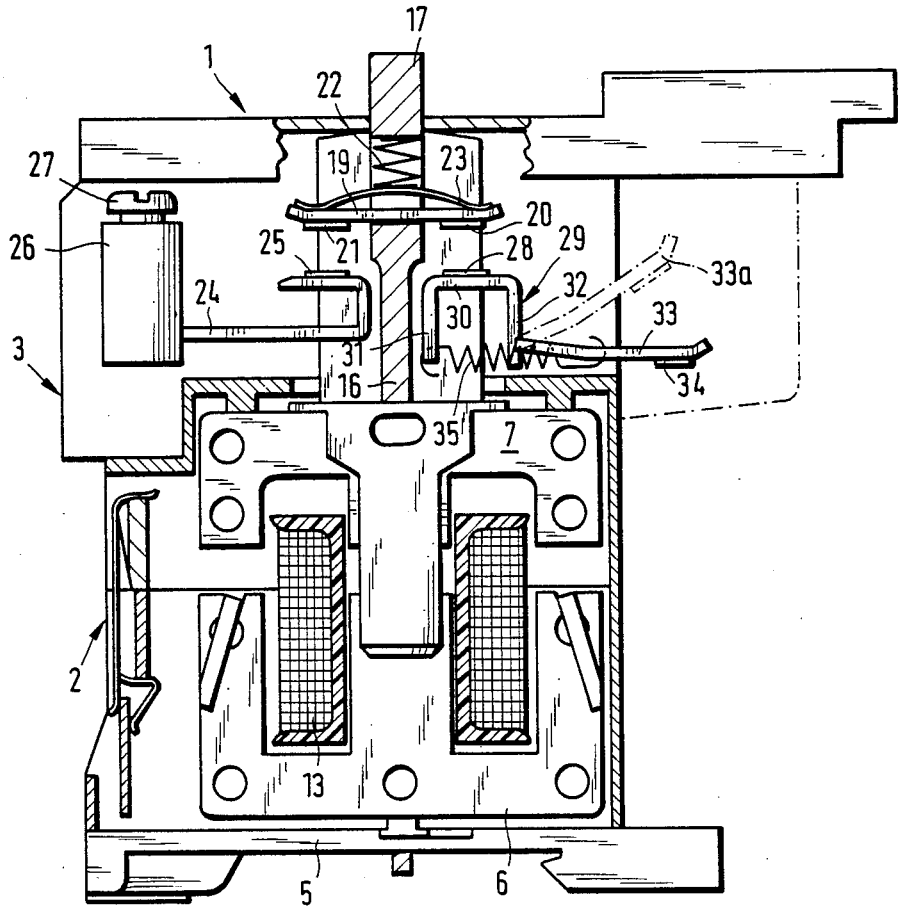
FIG. 2 is a vertical sectional view of the part of the contactor shown in FIG. 1, and additionally illustrates a spring-biased pivoted contact rail of a second set of contacts.
Figure 5:
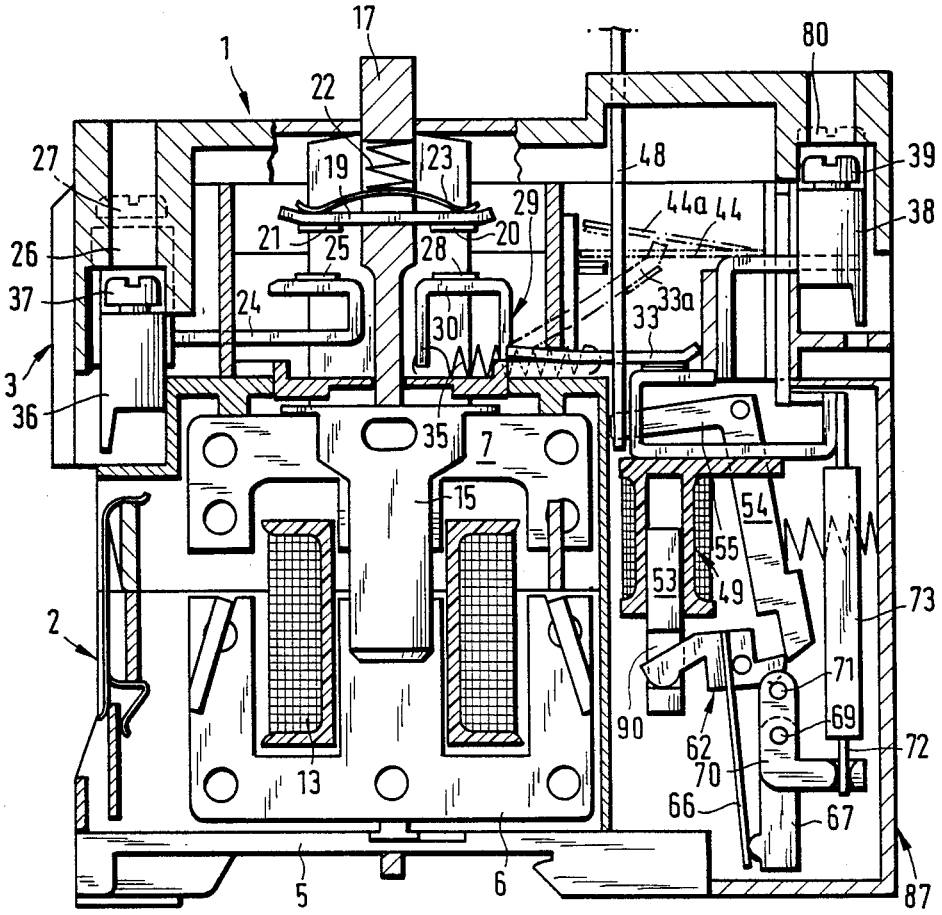
FIG. 5 is a vertical sectional view through the entire contactor, and illustrates the assembled relationship of the housing and components of FIG. 2 when assembled with the housing and components of FIG. 4.
Figure 6:
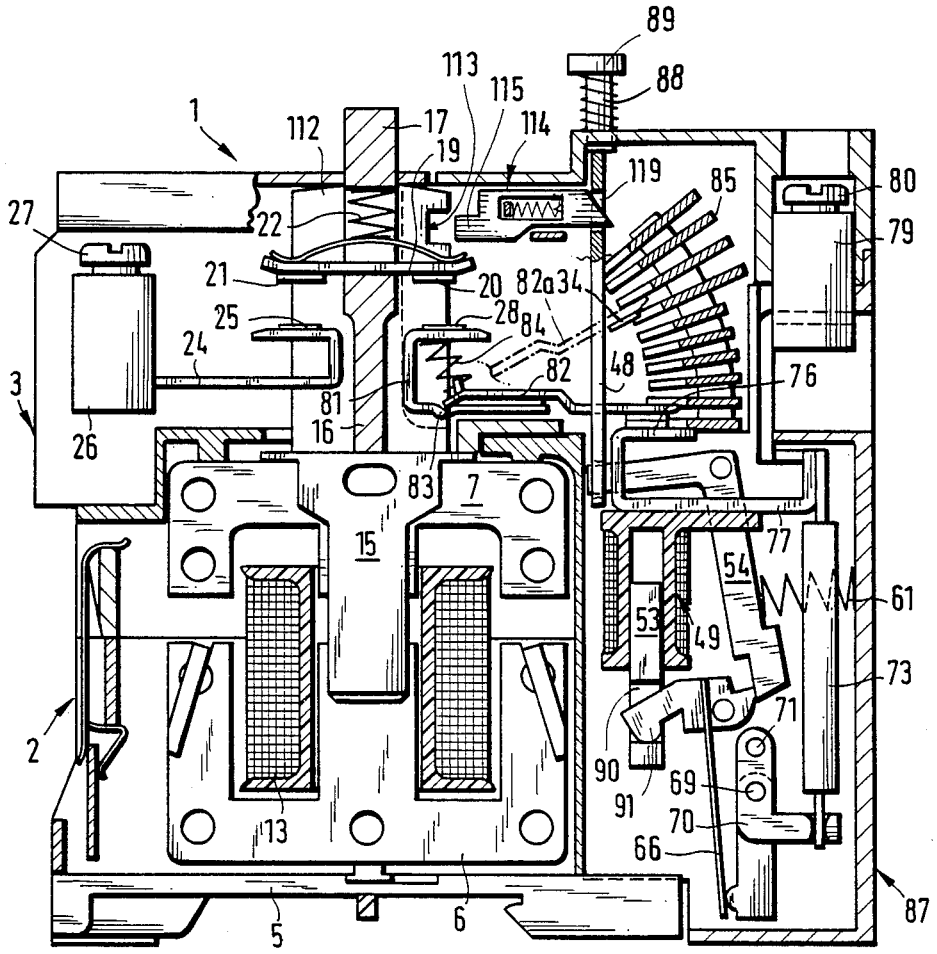
FIG. 6 is a vertical sectional view of another contactor similar to the contactor of FIG. 5, and illustrates a locking member associated with the bridge contact holder and the slider as well as an arc extinguishing chamber of a secondary contact arm.

A novel contactor 1 is fully illustrated in FIGS. 5 and 6 of the drawings, but for simplicity, clarity and ease of understanding, reference is first made to FIGS. 1 and 2.

The portion of the contactor 1 illustrated in FIGS. 1 and 2 includes a lower housing portion or housing part 2 and an upper housing part or housing portion 3 separated from each other along a horizontal dividing plane or edge 4 which is normal to the plane of FIGS. 1 and 2. The housing parts 2, can be connected together by conventional screw means, but preferably clamplike connection springs 10 are utilized for this purpose. Each of the springs 10 includes an elbow 11 at a lower end (unnumbered) and a locking bend 12 at an upper end (also unnumbered) which secure the housing parts 2, 3 together in a manner clearly apparent from FIGS. 1 and 2 of the drawings. The latter facilitates assembly and disassembly of the housing parts 2, 3 without resorting to tools, as is well known. The lower housing part 2 also includes a lower fastening plate 5 provided with quick connect/disconnect means (not shown) for connecting the fastening plate 5 to a standard mounting rail (also not shown). The contactor or circuit breaker 1 also includes a magnetic system which is defined by a core 6 having shorting rings 8 and 9. The core is conventionally fastened to the lower housing part 2. The magnetic system further includes a core 7 in the upper housing part 3 and an associated coil 13. The core 7 is fastened to a connector 14 from which projects lateral brackets 15 which laterally enclose the core 7. The core 7 and the connector 14 are carried by a push bar or contact bridge holder 16 having a pushbutton 17 projecting outwardly through an opening (unnumbered) in the housing upper part 3. The pushbutton 17 projects a maximum distance beyond the housing part 3 when contacts 20, 21, 25 and 28 (FIG. 5) are open and vice versa, thereby indicating the switching condition of the contactor 1 by the exposure of the pushbutton 17.

A window 18 is formed in the contact bridge holder 16 and receives a contact bridge 19 therein carrying the contacts 20, 21. The contact bridge 19 is biased by a helical compression spring 22 and by an additional bow leaf spring 23, and any further additional means can be provided for improving the guidance and positioning of the movable contacts 20, 21 relative to the associated fixed contacts 28, 25, respectively (FIGS. 5 and 6). The contacts 25 are carried by a fixed contact rail 24 which leads to a terminal 26 to which a wire can be connected through a contact connecting screw 27 in a conventional fashion. Another fixed rail 29 of a generally inverted U-shaped configuration carries the fixed contacts 28 on the upper side of a bight portion or web 30 of the rail 29. A tension spring 35 is connected at one end to a leg 31 (FIG. 2) of the rail 29 and the other end of the tension spring 35 is connected to a pivoted contact rail 33 carrying contacts 34 (FIG. 2). The pivot connection of the contact rail 33 is at an outside of the lower end of the leg 32 (FIG. 2) at a slight distance above the center line through the tension spring 35. Thus, in the position shown in solid lines in FIG. 2 the contact rail 33 together with the movable contact 34 carried thereby is biased clockwise and downwardly by the tension spring 35. However, when the contact rail 33 is pivoted counterclockwise from the solid position shown in FIG. 2 toward the phantom outline position **33*a* shown in FIG. 2 in a manner to be described more fully hereinafter, the tension spring 35 moves through the aforementioned plane passed dead center and the spring tension pulls the pivoted contact rail 33 from its dead center position to the phantom outline position 33*a* of FIG. 2**.

It is to be noted that the contactor 1 operates in three electrical phases so that in actual practice there are three contact bridges 19 associated with each set of the springs 22, 23, the contact bridge 19 and the contacts 20, 21 carried thereby. There are also three fixed contact rails 24 and 29 each with their separate terminals associated with the three sets of contacts 21, 28 . There are also three pivoted contact rails 33 each with its contact 34 and an associated tension spring 35. However, the drawings show only one of the latter components simply as a matter of expediency, simplicity and ease of understanding.

Figure 3:
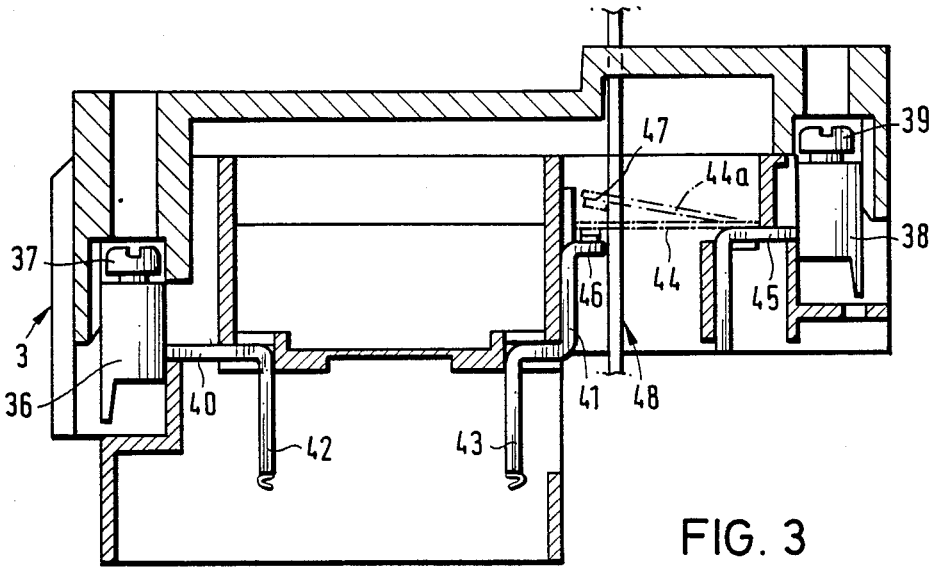
FIG. 3 is a vertical sectional view of an upper portion of the contactor shown in FIGS. 1 and 2, and illustrates an upper separate housing thereof carrying coil connectors and a coil connector contact-carrying arm.

Reference is now made to FIG. 3 of the drawings which illustrates the same upper housing part 3 as in FIGS. 1 and 2 except the vertical section is not taken through the plane of one of the electrical phases, as in FIGS. 1 and 2, but rather in a vertical plane containing coil terminals 36, 38. The coil terminals 36, 38 have conventional screw clamps 37, 39 and the latter are accessible from above through bore holes (unnumbered) to facilitate the introduction of a screwdriver for securing electrical conductors to or removing the same from the coil terminals 36, 38. The coil connection rails 40, 41 are carried by the housing part 3 with the coil connection rail 40 being connected to the coil terminal 36. Each of the coil connection rails 40, 41 also includes vertical legs 42, 43 which are connected to the coil 13 when the upper housing part 13 is assembled to the lower housing part 2 in the manner shown in FIGS. 1 and 2 of the drawings. Preferably the coil connecting wires (not shown) are not directly connected to the legs 42, 43 but are rather advantageously provided as bilateral spring components (not shown) which snap together when the upper housing part 3 is set on the lower housing part 2 to thereby assure reliable power transmission and simultaneously facilitate assembly and disassembly. More importantly is the fact that there is a biasing force directed toward a position which will open contacts 46, 47 of the current path of the coil terminals 36, 38. The additional contact for the coil connection is thus defined by a fixed contact 46 mounted on the upper side of the coil connector rail 41 and the movable contact 47 carried by a contact spring arm or rail 44. The contact spring arm 44 is connected to a current conducting rail 45 in electrical contact with the coil screw terminal 38. A slider 48 (FIGS. 3, 6 and 11) will be discussed further hereinafter but functions through a slot or opening (unnumbered) therein to open and close the contacts 46, 47 by moving the contact spring arm 44 between the solid and phantom outline position 44*a* shown in FIG. 3, as will be described more fully hereinafter. The phantom outline position 44*a* of the coil connection is, of course, the position at which the power to the coil 13 is interrupted.

Figure 4:
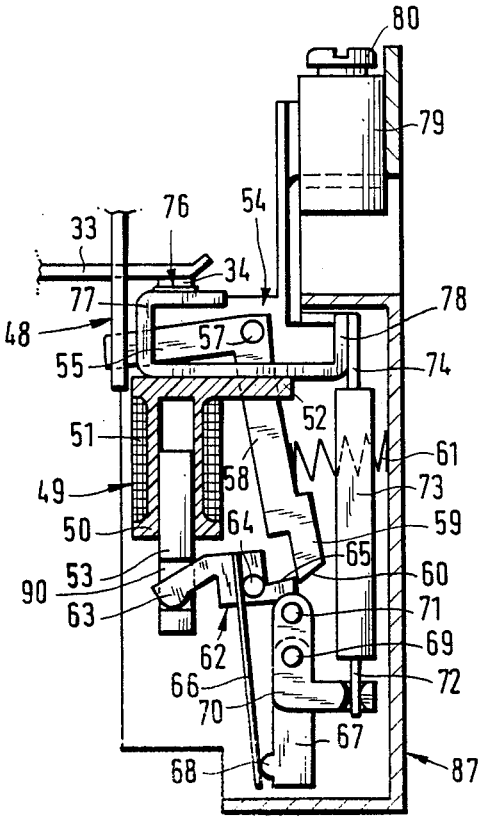
FIG. 4 is a fragmentary vertical sectional view taken through another separate housing of the connector shown in FIGS. 5 and 6, and illustrates three pivoted actuation members associated with magnetic and thermal trippers for opening the contacts through an associated slider.

Reference is now made particularly to FIGS. 4 and 5 of the drawings which illustrate another housing portion or housing part 87. In FIG. 4 the housing part 87 is shown as it might be removed from the housing parts 1 and 2, whereas in FIG. 5 the housing part 87 is shown assembled to the housing parts 1 and 2.

The housing part 87 carries magnetic tripper means or a magnetic tripper essentially comprising a coil support 50, a coil 51 and a fastener or support 52 which is fixed to the housing 87. A core 53 is mounted for reciprocal axial displacement relative to the coil 51 and has at its lower end opening means in the form of a window 90 which cooperates with an actuation member 62 in a manner to be described more fully hereinafter. However, for the moment suffice it to say that the actuation member 62 is one actuation member of actuation means generally designated by the reference numerals 48, 54, 62 and 70 or 93 of FIGS. 8 through 10. The actuation means 48, 54, 62, 70/93 is, therefore, defined by the slider 48, a first actuation member or angle piece 54, a second actuation member or angle piece 62 and a third actuation or angle piece 70 or 93.

The first actuation member 54 includes two legs or end portions 55, 58, the latter of which is offset to define an offset part or offset portion 59. The actuation member 54 is pivoted at 57 to the housing 87 generally at a juncture of the legs 55, 58. The offset portion of offset part 59 of the leg 58 also includes a nose 60. A compression spring 61 is conventionally housed, as shown in FIG. 4, between a wall (unnumbered) of the housing 87 and the leg 58 to normally bias the first actuation member or first angle piece 54 in a clockwise direction about the pivot 57.

The second actuation member or angle piece 62 is pivoted at 64 to the housing 87 and includes one leg or end portion 83 which seats in the window or opening 90 of the core 53, as described earlier. A leg (unnumbered) opposite the leg 63 is offset to define an offset or notch 65. A third leg 66 projects downwardly and is preferably constructed as a compensation strip whose lower free terminal end (unnumbered) normally engages a boss 68 of a depending arm 67 fixed to and forming part of the third actuation member or angle piece 70. The connection between the arms 67 and the actuation member 70 is a conventional fastener 69. The compensation strip 66 is simply a bimetallic element which is designed to compensate for room temperature to maintain uniformity of operation. Furthermore, there is but a single compensation strip 66 and a single lever arm 67 provided in the housing 87, whereas all other components heretofore described relative to FIG. 4 are present in threes because of the three phase electrical system.

Each of the third actuation members or angle pieces 70 is connected at 71 to the right-hand leg (unnumbered in FIG. 4) of the second actuation member 62 by a conventional connector 71. Another leg (unnumbered) of the third actuation member 70 has an opening (unnumbered) therein which receives a projecting stud 72 of a thermal tripper 73. The thermal tripper 73 is fastened at its upper end by a fastener 74 to a leg 78 of a fixed contact rail 77. The fixed contact rail 77 is essentially C-shaped in configuration and its leg 78 leads to a terminal 79 having a contactor connector screw 80. The fixed contact rail 77 carries a fixed contact 76 which cooperates with the previously described movable contact 34 of the contact rail 33 FIGS. 2 and 5). There is, of course, one fixed contact 76 for each electrical phase, namely, a total of three additional fixed contacts 76 for each of the three movable contacts 34 carried by the three contact rails 33. Once again, there is one magnetic tripper 49 and one thermal tripper 73 present for each of the phases, whereas all of the components described in relation to FIG. 4 are present three-fold, that is one for each phase, and they are perpendicular to the plane of the drawing though spaced apart. Obviously, the connection 71 and the pivot 69 and their mutual separation function to protect phase compensation.

The apparatus of FIG. 4 essentially operates in the following manner upon a surge of current, for instance from ten-fold of rated current to short. The magnetic tripper 49 of the particular electric phase is actuated and the core 53 is attracted impulsively upwardly (FIG. 4). The core 53 through the leg 63 pivots the second actuation member 62 clockwise about the pivot 64. Prior to the latter movement the right-hand leg of the second actuation member 62 blocked clockwise rotation of the first actuation member 54 due to its contact with the nose 60 of the leg 58. However, upon clockwise pivoting of the second actuation member 62, the right hand leg thereof drops downwardly and the spring 61 pivots the first actuation member clockwise about the pivot 57 moving the nose 60 of the offset portion 58 into the offset or recess 65 of the second actuation member 62. The clockwise pivoting of the first actuation member 54 moves the left-hand leg 55 of FIG. 4 upwardly which also moves the slider 48 upwardly which in turn pivots the contact rail 33 upwardly to open the contacts 34, 76 (FIGS. 2 and 4) and also moves the contact spring arm 44 (FIG. 4) from the closed position to the open position (44*a* of FIG. 3). A like operation takes place in the event of a slow rise of excess current, illustratively of to six-fold to eight-fold of the rated current, in which case the thermal tripper 73 responds in at least one of the electrical phases. The thermal tripper 73 which responds to the excess current pivots the third actuation member 70 about its pivot 69 through the stud 72 whereby the second actuation member 62 is again pivoted clockwise through the connection 71. In other words, as the third actuation member 70 pivots clockwise, the connection at 71 pivots the second actuation member 62 clockwise once again freeing the nose 60 which enters the offset 65 under the force of the compression spring 61 as the first actuation member 54 rotates clockwise about the pivot 57 again shifting the slider 48 upwardly to open the contacts in the manner heretofore described. FIG. 5 best illustrates the manner in which the slider 48 simultaneously pivots the contact rail 33 and the contact spring arm 44. The bottom end (unnumbered) of the slider 48 shown in FIG. 5 is operatively connected to the left leg 55 of the first actuation member 54 by, for example, the leg 55 being inserted in an opening or window (unnumbered) in the slider 48. A similar opening or notch (unnumbered) is provided in the slider 48 and receives the contact spring arm 44. Accordingly, as the slider 8 moves upwardly in the manner heretofore described, the pivoted contact rail 33 is moved to the over center position after which the tension spring 35 abruptly pivots the contact rail to the phantom outline position 33*a*. Obviously, the opening or notch in the slider 48 associated with the contact rail 33, as well as the contact spring arm 44, is relatively elongated in the direction of the length of the slider 48 to permit the freedom of pivoting movement of both of the latter-noted elements 33, 44. The latter upward movement of the slider 48 occurs due to a malfunction and the operation of either or both of the trippers 49, 73, and after the malfunction has been eliminated, the contacts can be closed by moving the slider 48 downwardly to pivot the first actuation member 54 in a counterclockwise direction about the pivot 57. In order to push the slider 48 downwardly an upper end thereof is designed with a reset button 89 (FIG. 6) and preferably a spring 88 normally biases the slider 48 upwardly, as is evident from FIG. 6. Obviously, when the button 89 is pushed downwardly, the slider 48 moves downwardly pivoting the contact rail 33 and the spring arm 44 to the ON position at which the respective contacts 34, 76 FIG. 4) and 46, 47 (FIG. 3) are closed.

The contactor heretofore described includes several features and advantages heretofore unprovided for in prior art contactors of this type. On the one hand manual switching is possible through manipulation of the slider 48, yet remote operation between the ON and OFF positions is achieved through the trippers 49, 73. Each electrical phase is protected against overload both by the magnetic trippers 49 and the thermal trippers 73. The additional contacts 34, 76 and 46, 47 are both biased toward the open position for each electrical phase through both the biasing force of the compression spring 61 and the tension spring 35 and thus the contactor will be switched to its OFF position at every malfunction even though the main contacts 20, 21, 25 and 28 are fused together. The switch condition (ON or OFF of the contactor 1 is also permanently visible from the outside of the housing by virtue of the position of the push-buttons 17, 89 (FIG. 6). Because of the latter advantages, the contactor 1 is advantageously applicable as a motor protecting switch and due to its versatility and compactness, the contactor 1 can be mounted on a standard electrical mounting wall without requiring significantly greater space than that provided for typically standardized contactor widths (perpendicular to the planes of the figures), whereby the contactor 1 can be mounted tightly against other and possible conventional contactors in a switching console or on an assembly plate. Lastly, wiring is minimized since there are only three wires for each of the three electric phases and two more wires with terminal screws for the coil connection, a total of eight connections per assembly or disassembly with, of course, all of the terminal screws being entirely accessible for access and/or servicing. Furthermore, the housing part 87 of FIG. 4 may selectively assume different designs as, for example, being integrated with the lower housing part 2 or divided to match the lower housing part 2 and the upper housing part 3. The housing part 87 may be a separate housing part, as illustrated in FIG. 3, yet the same can be rigidly joined to other housing parts by screws or by such quick connect and disconnect couplings, as shown in FIG. 1, namely, connector springs 10. In an especially advantageous embodiment of the housing part 87 the latter can be widened at the top to house further contacts both for the electrical phases and for the coil connection. Only a slight design modification is needed to accomplish the latter, and an example thereof is shown in FIG. 6 and particularly FIG. 7.

Figure 7:
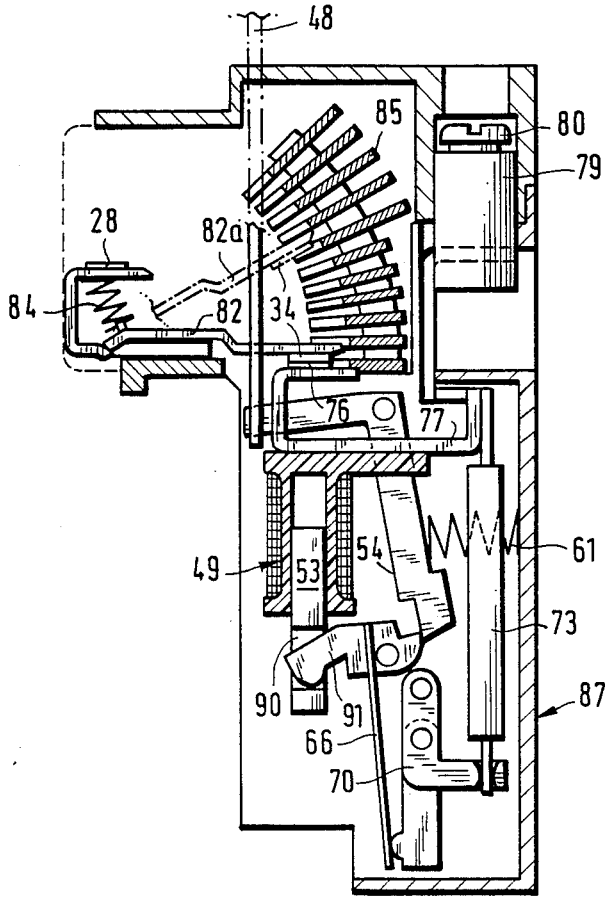
FIG. 7 is a vertical sectional view of a portion of the contactor of FIG. 6 illustrating the manner in which the housing associated therewith can be removed or reassembled relative to the housing of FIG. 1.

The embodiment of the contactor 1 of the invention shown in FIGS. 6 and 7 to a large extent coincides with the contactor 1 of FIGS. 1 through 5 and, therefore, like reference numerals have been utilized to indicate the same components in both embodiments. However, in the case of the contactor 1 of FIGS. 6 and 7, a fixed contact rail 81 is provided of a design differing from the contact rail 29 (FIG. 2). While the fixed contact rail 81 is also U-shaped, it includes a vertical web (unnumbered) and two horizontal legs (also unnumbered) with the lower leg having a kink or recess 83 which acts as a bearing or pivot point for a pivoting or pivotal contact rail or arm 82. A compression spring 84 is obliquely positioned between the upper horizontal leg (unnumbered) and a conventional keeper projecting upwardly from the contact rail 82 which assures that the spring 84 is held in the position illustrated in FIGS. 6 and 7. The contact rail 82 can move between the solid position illustrated in FIGS. 6 and 7 and the phantom outline position 82*a* in which the contacts 34, 76 are respectively closed/ON and open/OFF. In this case the spring 84 creates a force biasing the pivotal contact rail 82 toward its closed position to reinforce the electrical closure pressure when the contacts 34 and 76 are closed, but as in the case of the tension spring 35 (FIG. 2), the contact rail arm 82 when pivoted to its open position 82*a* similarly passes through a dead center position and the spring 84 biases the contact rail arm 82 to its open position 82*a*. In addition, means for extinguishing arcing is provided in the form of arc extinguishing chambers or laminations 85 mounted along the range of pivoting movement of the contacts 34 as they are carried between their open and closed positions relative to the contacts 76.

Figure 8:
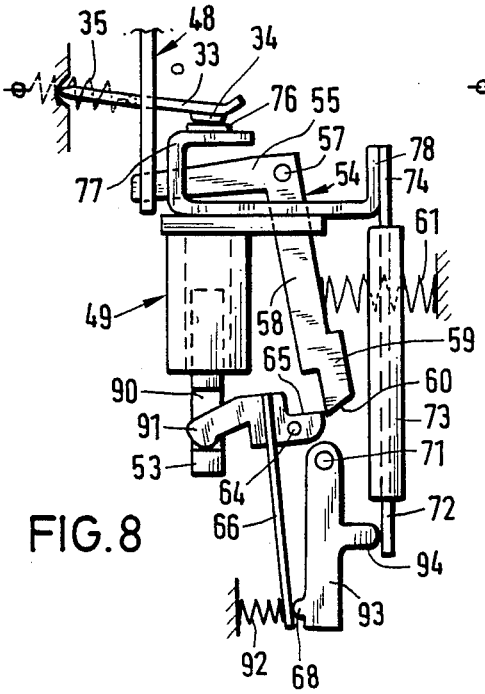
FIGS. 8, 9 and 10 are diagrammatic views of another actuation system, and illustrates three pivotal actuation members and thermal and magnetic trippers associated therewith.
Figure 9:
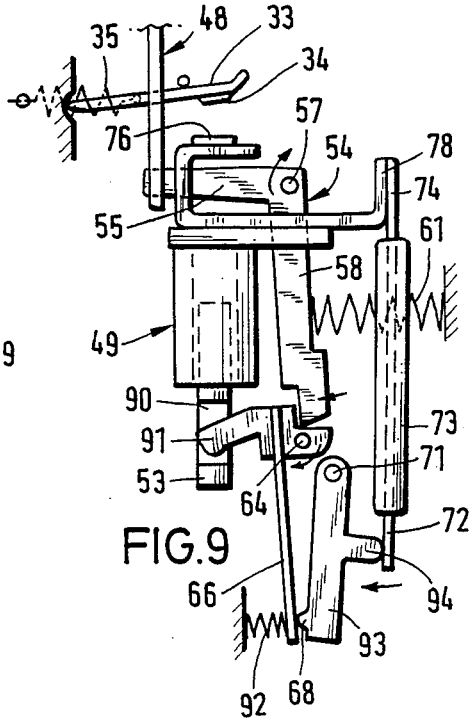
Figure 10:
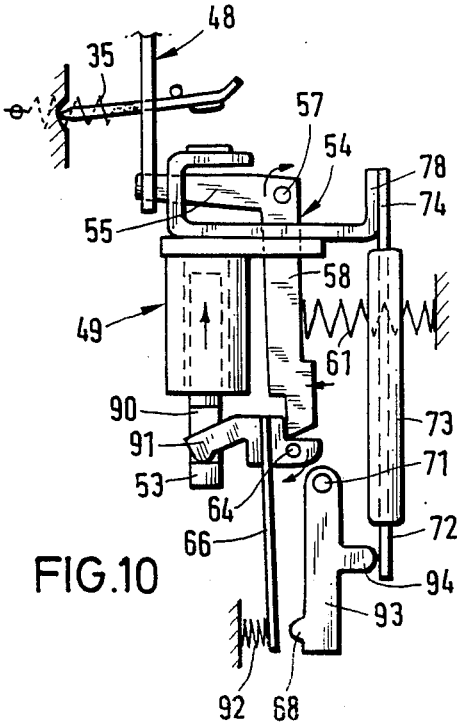

Reference is now made to FIGS. 8 through 10 of the drawings which illustrate a slightly simplified contactor 1 in three different operating positions, and again like reference numerals have been applied to designate components identical to those mentioned earlier herein. Magnetic trippers 49 and thermal trippers 73 are present in this embodiment, again one tripper for each of the electrical phases or three mutually spaced trippers perpendicular to the plane of the drawing. Likewise actuation means 48, 54, 62 and 93 are provided for opening the contacts 34, 76, as well as the contacts 46, 47 in response to the operation of the magnetic tripper 49 and/or the thermal tripper 73. However, in the embodiment of FIGS. 8 through 10 the third actuation member or angle piece 93 is of a one-piece construction and is pivoted at 71 to the housing (not shown and unnumbered). instead of being pivotally connected to the right-hand leg of the second actuation member 62, as heretofore described relative to FIG. 4. The third actuation member 93 includes a projection or nose 94 which bears against the lower stud 72 of the thermal tripper 73 while another projection or nose 68 is in line for contact with but spaced from a lower end of a depending leg or compensation member 66 of the second actuation member 62 which is in turn spring-biased by a spring 92 in a direction tending to pivot the second actuation member 62 in a counterclockwise direction, as viewed in each of FIGS. 8 through 10.

When the contactor 1 of FIGS. 8 through 10 is ON (FIG. 8), the spring 92 holds the leg 66 in contact with nose 68 which in turn holds the third actuation member 93 in the position illustrated with the nose 94 contacting the stud 72 of the thermal tripper 73. The nose 60 of the first actuation member 54 is in contact with the right leg (unnumbered of the second actuation member 62 adjacent the offset 65 thereof. Should the core 53 rise or the thermal tripper 73 pivot clockwise, the compression spring 61 again pivots the first actuation member 54 about its pivot 57 moving the leg 55 upwardly to similarly move the slider 48 upwardly as heretofore described to open the contacts 34, 76 and 46, 47. However, in this embodiment the main difference is that upon tripping by the thermal tripper 73 the third actuation member 93 is pivoted clockwise about its pivot 71, as shown in FIG. 9, causing the second actuation member 62 to pivot clockwise against the biasing force of the spring 92 which again permits the nose 60 to enter the offset 65 (FIG. 10) opening the contacts as earlier described.

Reference is now made to FIGS. 11 and 12 of the drawings which illustrate a preferred form of the slider 48 and the manner in which the same functions in association with three second actuation members 102, 103 and 104 corresponding to the actuation member or angle piece 54 heretofore described. In this embodiment of the slider 48, which is also illustrated in FIG. 6, the slider 48 is essentially a rectangular plate suitably displaced vertically in guides (not shown) within the housing part 87 along the path indicate by the double headed arrow 95 (FIG. 11). The slider 48 includes three openings or windows 96, 97 and 98 at its lower end portion (unnumbered) which receive respective legs 99, 100 and 101 of the first actuation members or angle pieces 102, 103, 104, respectively. Further openings or windows 105, 106 and 107 receive pivoting contact rails 109, 110 and 111, each corresponding to the pivoted contact rail 33 of FIG. 4 and the contact rail 82 of FIG. 6. Depending upon the spacial arrangement of the additional contacts 46, 47 (FIG. 3) of the contact spring 44 for the coil connection, a further window 108 (FIG. 11) is provided in an upper corner of the slider 48 for receiving the contact spring arm 44. The location of the opening or window 108 and the contact spring arm 44 is simply selected as a matter of convenience and these can be located anywhere desired generally as necessitated by the overall design of the contactor 1. Obviously, as noted earlier, all of the openings are relatively elongated in the direction of slider reciprocation 95 to effect the reliable operation of the contactor 1 as heretofore described.

It is particular important that locking means 114 be provided between the slider 48 and the contact bridge holder 16 (FIG. 6) to assure that the additional contacts 34, 76; 46, 47 and those (not shown) carried by the pivoting contact rails 109 through 111 can not be closed if the main contacts 20, 21, 28 and 25 are closed. In order to accommodate such locking function, the contact bridge holder 17 includes a suitable integral head piece 112 which is also integral with the push bar 16 and thus is connected to the contactor core 7. The lock or locking means 114 is mounted in the housing part 87 (FIG. 12) for sliding movement generally transverse to the slider 48 and the contact bridge holder 16. A suitable guide 117 is provided to maintain the slider 114 housed in the housing part 87 for sliding movement generally horizontally, as viewed in FIG. 12, toward the right under the influence of a compression spring 117 seated on a stationary abutment 121 and housed in an opening (unnumbered) of the sliding lock 114. When the slider 148 is in its uppermost position (FIG. 12), an edge 120 of a window or opening 119 rests against an upper portion of a slanted or cam surface or face 118 of the locking slider 114 An opposite end of the locking slider 114 has an offset projection 115 which is selectively received in a notch or opening 113 of the headpiece 112 of the contact bridge holder 16 only when the contact bridge holder 10 is in its upper position (FIGS. 1 and 2) with the main contacts 20, 21, 25 and 28 open, as is best illustrated in FIG. 6.

Assuming that the main contacts 20, 21, 25 and 28 are open and the additional contacts 34, 76, 46, 47 and those contacts carried by the arms 109, 110 and 111 are all open, the contactor 1 is turned to its on or reset position to reset the additional contacts by depressing the head 89 of the slider 48 downwardly. As this occurs, the edge 120 of the opening 119 bears against the slanted or cam surface 118 of the locking slider 114 and shifts the same to the left, as viewed in FIGS. 6 and 12. Since the main contacts 20, 21, 25 and 28 are opened, the notch or opening 118 is aligned with the projection 121 and will receive the same permitting the slider 48 to continue its downward movement as the edge 120 forces the end of the sliding lock 114 out of the opening 119. As the slider 48 moves downwardly, it pivots the contact rail 33 and the contact spring arm 44 to close the respective contacts 34, 76 and 46, 47 in the manner heretofore described, as well as the contacts associated with the arms 109 through 111. This then turns on all of the additional contacts for the coil and the three electrical phases without danger because the main contacts 20, 21, 25 and 28 are opened. The same downward movement of the slider 48 "sets" the actuation means 48, 54, 62,

70/93 (FIGS. 4 and 8) to the operative positions shown in the latter-noted Figures in the manner heretofore described. If the contactor 1 is now turned on by depressing the pushbutton 17, the contactor bridge 16 and the headpiece 112 moves downwardly until the contacts 20, 21, 25, 28 are closed. The guide 16 is suitably mounted for vertically guiding movement, and thus as the pushbutton 17 is depressed the headpiece 112 pulls the sliding lock 114 and the guide 116 downwardly from a position above the edge 120 of the window 119 to a position at which the spring 117 shifts the locking slide 114 to the right and into the opening 119 thereby allowing for full normal operation of the contactor 1. In the event of malfunction in the operation of either of the trippers 49, 73 heretofore described the slider 48 will be impulsively moved upwardly into the uppermost position shown in FIG. 2 and the transverse locking slider 114 along with its guide 116 is again moved into the position shown. If now one or more of the main contacts 20, 21, 25 and 28 are fused together and the contact bridge holder 17 is in its lowermost position, resetting by depressing the pushbutton 89 can not take place because the projection 115 of the sliding lock 114 is no longer in alignment with the notch or opening 113 and is instead in alignment with and will abut against the rightward projecting unnumbered portion of the headpiece 112 above the notch 113. Hence, the sliding lock piece 114 can not be moved to the left upon the button 89 being pushed downwardly and the additional contacts 34, 76, 46 and 47 can not be closed when the main contacts 20, 21, 25 and 28 are fused or otherwise closed. It is only after the malfunction has been entirely eliminated that it is possible after the main contacts 20, 21, 25 and 28 have been opened that the contactor has been reset and the additional contacts can be closed. Obviously, the latter not only avoids danger to equipment and personnel, but since the additional contacts can be turned on only in the absence of a load, the same eliminates contact closure chatter.

Although a preferred embodiment of the invention has been specifically illustrated and described herein, it is to be understood that minor variations may be made in the apparatus without departing from the spirit and scope of the invention, as defined in the appended claims.

We claim:

1. A contactor comprising a first plurality of contact means (20, 21, 25, 28) for selectively opening and closing an electric circuit and a second plurality of additional contact means (34, 76 and 46, 47) for each electrical phase and a coil connection of a coil (13) of an associated magnetic system, respectively; thermal trippers (73) and magnetic trippers (49) for each phase, and actuation means (48, 54, 62, 70, 93) selectively operable by the tripping of one of said thermal trippers (73) and said magnetic trippers (49) for moving said second plurality of additional contact means (34, 76 and 46, 47) from closed to open positions thereof to open the associated electric circuit.

2. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, and said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated.

3. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, and said second movable actuation member means (62) normally blocks movement of said first movable actuation member means (54) to maintain said second plurality of additional contact means (34, 76 and 46, 47) closed when neither of said tripper has been actuated.

4. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second movable actuation member means (62) normally blocks movement of said first movable actuation member means (54) to maintain said second plurality of additional contact means (34, 76 and 46, 47) closed when neither of said trippers has been actuated, first means (63, 90) responsive to actuation of said magnetic tripper (49) for moving said second movable actuation member means (62) out of blocking relationship with said first movable actuation member means, and second means (70, 66 or 93, 66) responsive to actuation of said thermal tripper (73) for moving said second movable actuation member means (62) out of blocking relationship with said first movable actuation member means.

5. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47 when either tripper (73, 49) has been actuated, said second movable actuation member means (62) normally blocks movement of said first movable actuation member means (54) to maintain said second plurality of additional contact means (34, 76 and 46, 47) closed when neither of said trippers has been actuated, first means (63, 90) responsive to actuation of said magnetic tripper (49) for moving said second movable actuation member means (62) out of blocking relationship with said first movable actuation member means, second means (70, 66 or 93, 66) responsive to actuation of said thermal tripper (73) for moving said second movable actuation member means (62) out of blocking relationship with said first movable actuation member means, and at least one of said first and second movable actuation member means (54, 62) is mounted for pivoting movement relative to the other of said first and second movable actuation member means.

6. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second movable actuation member means (62) normally blocks movement of said first movable actuation member means (54) to maintain said second plurality of additional contact means (34, 70 and 46, 47) closed when neither of said trippers has been actuated, first means (63, 90) responsive to actuation of said magnetic tripper (49) for moving said second movable actuation member means (62) out of blocking relationship with said first movable actuation member means, second means (70, 66 or 93, 66) responsive to actuation of said thermal tripper (73) for moving said second movable actuation member means (62) out of blocking relationship with said first movable actuation member means, and each of said first and second movable actuation member means (54, 62) are mounted for pivoting movement relative to each other.

7. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said first movable actuation member means (54) is directly actuated upon actuation of said second movable actuation member means (62) by operation of one of said trippers, and said first movable actuation member means (54) is indirectly actuated by operation of the other of said trippers.

8. The contactor as defined in claim 1 including means (61) for biasing said first movable actuation member means (54) into abutting contact with said second movable actuation member means (62) when neither of said trippers has been operated whereby said first and second plurality of contact means (20, 21, 25, 28 and 37, 76, 46, 47) are maintained in their open position and upon operation of either of said trippers (73, 49), and said biasing means (61) provides the opening force for said first and second plurality of contact means (20, 21, 25, 28 and 37, 76, 46, 47).

9. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated.

10. The contactor as defined in claim 1 wherein said actuation means (48, 54, 62, 60, 93) includes first, second and third relatively pivotal actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated.

11. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) trippers, and said second movable actuation member means (62) normally blocks movement of said first movable actuation member means (54) to maintain said second plurality of additional contact means (34, 76 and 46, 47) closed when neither of said trippers has been actuated.

12. The contactor as defined in claim 1 wherein said actuation means (48, 54,, 62, 60, 93) includes first, second and third relatively pivotal actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) trippers, and said second movable actuation member means (62) normally blocks movement of said first movable actuation member means (54) to maintain said second plurality of additional contact means (34, 76 and 46, 47) closed when neither of said trippers has been actuated.

13. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) tripper, and said second movable actuation member means (62) normally blocks movement of said first movable actuation member means (54) to maintain said second plurality of additional contact means (34, 76 and 46, 47) closed when neither of said trippers has been actuated, said magnetic tripper (49) includes a movable core (53), said second movable actuation member means (62) is an angular member having opposite legs (63, 65), one of said legs (63) is operatively coupled to said core (53), and the other of said legs (65) blocks movement of said first movable actuation member means (54).

14. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) tripper, said second movable actuation member means (62) normally blocks movement of said first movable actuation member means (54) to maintain said second plurality of additional contact means (34, 76 and 46, 47) closed when neither of said trippers has been actuated, said magnetic tripper (49) includes a movable core (53), said second movable actuation member means (62) is an angular member having a plurality of legs (3, 65, 66), one of said legs (63) is operatively coupled to said core (53), another of said legs (65) blocks movement of said first movable actuation member means (54), and yet another of said legs (66) is operatively coupled to said thermal tripper (73).

15. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) tripper, said second movable actuation member means (62) normally blocks movement of said first movable actuation member means (54) to maintain said second plurality of additional contact means (34, 76 and 46, 47) closed when neither of said trippers has been actuated, said magnetic tripper (49) includes a movable core (53), said second movable actuation member means (62) is an angular member having opposite legs (63, 65), one of said legs (63) is operatively coupled to said core (53), the other of said legs (65) blocks movement of said first movable actuation member means (54), said other leg (65) is provided with an offset (generally at 65), said first movable actuation member means (54) is an angular member (54) having opposite legs (55, 59) said second movable actuation angular member other leg (65) being in blocking engagement with a first leg (59) of said first movable actuation member means (54) when said contacts are closed, and said first movable actuation member first leg (59) being received in said offset (generally 65) incident to the movement of said contacts to the open position thereof.

16. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70, respectively) is each an angular member having at least two legs, pivot means (64, 69) mounting said second and third angular members for pivoting movement, said pivot means (64, 69) being spaced a first distance from each other, a first leg (66) of said second angular member being in contact with a first leg (67) of said third angular member, a second leg (generally 71) of said third angular member (70) being in contact with a second leg (generally 65) of said second angular member at a point (generally 71) spaced a second distance from said second angular member pivot means (64), and said first distance is greater than said second distance.

17. The contactor as defined in claim 1 wherein said actuation means (48, 54, 62, 60, 93) includes first, second and third relatively movable actuation member means (54, 62 and 70 or 93) for preventing the opening of said second plurality of additional contact means (34, 70 and 46, 47) when neither of said trippers (73, 49) has been actuated and for opening said second plurality of additional contact means (34, 76 and 46, 47) when either tripper (73, 49) has been actuated, said second and third actuation member means (62, 70, respectively) is each an angular member having at least two legs, pivot means (64, 69) mounting said second and third angular members for pivoting movement, said pivot means (64, 69) being spaced a first distance from each other, a first leg (66) of said second angular member being in contact with a first leg (67) of said third angular member, said second angular member first leg (66) is defined as a compensation strip means for compensating for variations in room temperature, a second leg (generally 71) of said third angular member (70) being in contact with a second leg (generally 65) of said second angular member at a point (generally 71) spaced a second distance from said second angular member pivot means (64), and said first distance is greater than said second distance.

18. The contactor as defined in claim 1 wherein said second plurality of additional contact means (34, 76) for each electrical phase includes a pivoting contact rail (33, 82) carrying first movable contacts (34) cooperative with second fixed contacts (76) carried by a stationary contact rail (77).

19. The contactor as defined in claim 1 wherein said second plurality of additional contact means (46, 47) for said coil connection includes a contact spring (44) having opposite ends, one of said connection contact spring ends being connected to a current conducting rail (45) of the coil connection, and another of said coil connection contact spring ends carrying a contact (47) cooperative with a contact (46) of a coil connection rail (41).

20. The contactor as defined in claim 1 including first housing means (2) for housing said first plurality of contact means (20, 21, 25, 28), and separate second housing means (87) connectable to and removable from said first housing means (2) as a unit for housing at least part (76) of said second plurality of additional contact means, said thermal and magnetic trippers (73, 49), and said actuation means (48, 54, 62, 70, 93).

21. The contactor as defined in claim 1 wherein said second plurality of additional contact means (34, 76) for each electrical phase includes a pivoting contact rail (33, 82) carrying first movable contacts (34) cooperative with second fixed contacts (76) carried by a stationary contact rail (77), and means (85) for extinguishing arcing along the pivotal path of said pivoting contact rail (33, 82).

22. The contactor as defined in claim 1 wherein said actuation means (48, 54,, 62, 60, 93) includes first, second and third relatively movable actuation member means (54, 62 and 70 or 93) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, said second and third actuation member means (62, 70 or 93, respectively) are operated by said respective magnetic (49) and thermal (73) tripper, said second movable actuation member means (62) normally blocks movement of said first movable actuation member means (54) to maintain said second plurality of additional contact means (34, 76 and 46, 47) closed when neither of said trippers has been actuated, said third actuation member (93) includes a nose (94) operable by said thermal tripper (73), said second actuation member (62) includes a leg (66) engageable by said third actuation member (93), and biasing means (92) for urging said second actuation member leg (66) in a direction toward said third actuation member (93).

23. The contactor as defined in claim 1 wherein said actuation means (48, 54, 62, 70, 93) includes reciprocal slider means (48) movable in one direction for moving said second plurality of additional contact means (34 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, and opening means (96, 97, 98) in said slider means (48) for receiving therein a portion (55, 99–101) of said first actuation member means (54, 102, 103, 104).

24. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, opening means (96, 97, 98) in said slider means (48) for receiving therein a portion (55, 99–101) of said first actuation member means (54, 102, 103, 104), said second plurality of additional contact means (34, 74) for each electrical phase includes a pivoting contact rail (33, 82) carrying first movable contacts (34) cooperative with second fixed contacts (76) carried by a stationary contact rail (77) and further opening means (105, 106, 107) in said slider means (48) for receiving said pivoting contact rail (33, 82, 109, 110, 111).

25. The contactor as defined in claim 1 wherein said actuation means (48, 54, 62, 70, 93) includes reciprocal slider means (48) movable in one direction for moving said second plurality of additional contact means (34, 76 and 46, 47) from closed to open positions thereof, said actuation means (48, 54, 62, 70) includes first and second relatively movable actuation member means (54, 62) for preventing the opening of said second plurality of additional contact means (34, 76 and 46, 47) when neither of said trippers (73, 49) has been actuated and for opening said second plurality of additional contact means (34, 76 and 46, 47) when either tripper (73, 49) has been actuated, opening means (96, 97, 98) in said slider means (48) for receiving therein a portion (55, 99–101) of said first actuation member means (54, 102, 103, 104), said second plurality of additional contact means (46, 47) for said coil connection includes a contact spring (44) having opposite ends, one of said coil connection contact spring ends being connected to a current conducting rail (45) of the coil connection, another of said coil connection contact spring ends carrying a contact (47) cooperative with a contact (46) of a coil connection rail (41), and further opening means in said slider means (48) for receiving said contact spring (44).

26. The contactor as defined in claim 1 including a movable contact bridge holder (17) carrying movable contacts (20, 21) of said first plurality of contact means (20, 21, 25, 28) which is movable between first and second positions at which said first plurality of contact means (20, 21, 25, 28) are respectively open and closed, said actuation means (48, 54, 62, 70, 93) includes reciprocal slider means (48) movable in one direction for moving said second plurality of additional contact means (34, 76 and 46, 47) from closed to open position and in a second direction for moving said second plurality of additional contact means (34, 76 and 46, 47) from open to closed position, and locking means (114) for locking said slider means (48) and preventing movement thereof in said second direction unless said first plurality of contact means (20, 21, 25, 28) are in the open position thereof.

27. The contactor as defined in claim 1 including a movable contact bridge holder (17) carrying movable contacts (20, 21) of said first plurality of contact means (20, 21, 25, 28) which is movable between first and second positions at which said first plurality of contact means (20, 21, 25, 28) are respectively open and closed, said actuation means (48, 54, 62, 70, 93) includes reciprocal slider means (48) movable in one direction for moving said second plurality of additional contact means (34, 76 and 46, 47) from closed to open position and in a second direction for moving said second plurality of additional contact means (34, 76 and 46, 47) from open to closed position, locking means (114) for locking said slider means (48) and preventing movement thereof in said second direction unless said first plurality of contact means (20, 21, 25, 28) are in the open position thereof, and said locking means (114) includes a reciprocal slider (114).

28. The contactor as defined in claim 1 including a movable contact bridge holder (17) carrying movable contacts (20, 21) of said first plurality of contact means (20, 21, 25, 28) which is movable between first and second positions at which said first plurality of contact means (20, 21, 25, 28) are respectively open and closed, said actuation means (48, 54, 62, 70, 93) includes reciprocal slider means (48) movable in one direction for moving said second plurality of additional contact means (34, 76 and 46, 47) from closed to open position and in a second direction for moving said second plurality of additional contact means (34, 76 and 46, 47) from open to closed position, locking means (114) for locking said slider means (48) and preventing movement thereof in said second direction unless said first plurality of contact means (20, 21, 25, 28) are in the open position thereof, said locking means (114) includes a reciprocal slider (114), said locking means (114) includes opening means (119) for receiving a portion (118) of said slider (114) to prevent slider movement, and said contact bridge holder (17) includes means (113) for permitting the removal of said slider portion (118) from said opening means (119) when said first plurality of contact means (20, 21, 25, 28) are in the open position thereof.

29. The contactor as defined in claim 1 including a movable contact bridge holder (17) carrying movable contacts (20, 21) of said first plurality of contact means (20, 21, 25, 28) which is movable between first and second positions at which said first plurality of contact means (20, 21, 25, 28) are respectively open and closed, said actuation means (48, 54, 62, 70, 93) includes reciprocal slider means (48) movable in one direction for moving said second plurality of additional contact means (34, 76 and 46, 47) from closed to open position and in a second direction for moving said second plurality of additional contact means (34, 76 and 46, 47) from open to closed position, locking means (114) for locking said slider means (48) and preventing movement thereof in said second direction unless said first plurality of contact means (20, 21, 25, 28) are in the open position thereof, said locking means (114) includes a reciprocal slider (114), said locking means (114) includes opening means (119) for receiving a portion (118) of said slider (114) to prevent slider movement, said contact bridge holder (17) includes means (113) for permitting the removal of said slider portion (118) from said opening means (119) when said first plurality of contact means (20, 21, 25, 28) are in the open position thereof, and said contact bridge holder (17) includes means for preventing the removal of said slider portion (118) from said opening means (119) when said first plurality of contact means (20, 21, 25, 28) are in the closed position thereof.

30. The contactor as defined in claim 1 including a movable contact bridge holder (17) carrying movable contacts (20, 21) of said first plurality of contact means (20, 21, 25, 28) which is movable between first and second positions at which said first plurality of contact means (20, 21, 25, 28) are respectively open and closed, said actuation means (48, 54, 62, 70, 93) includes reciprocal slider means (48) movable in one direction for moving said second plurality of additional contact means (34, 76 and 46, 47) from closed to open position and in a second direction for moving said second plurality of additional contact means (34, 76 and 46, 47) from open to closed position, locking means (114) for locking said slider means (48) and preventing movement thereof in said second direction unless said first plurality of contact means (20, 21, 25, 28) are in the open position thereof, said locking means (114) includes a reciprocal slider (114), said locking means (114) includes opening means (119) for receiving a portion (118) of said slider (114) to prevent slider movement, said contact bridge holder (17) includes means (113) for permitting the removal of said slider portion (118) from said opening means (119) when said first plurality of contact means (20, 21, 25, 28) are in the open position thereof, said contact bridge holder (17) includes means for preventing the removal of said slider portion (118) from said opening means (119) when said first plurality of contact means (20, 21, 25, 28) are in the closed position thereof, and cam means (118) cooperative with said opening means (119) for moving said slider (114) to its unlocked position when said first plurality of contact means (20, 21, 25, 28) are in the open position thereof.

* * * * *